US012037214B2

(12) United States Patent
Hosohara et al.

(10) Patent No.: US 12,037,214 B2
(45) Date of Patent: Jul. 16, 2024

(54) SHEET FEEDING DEVICE AND IMAGE FORMING APPARATUS

(71) Applicant: CANON KABUSHIKI KAISHA, Tokyo (JP)

(72) Inventors: Kazuhiro Hosohara, Kanagawa (JP); Tomoya Tateishi, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 239 days.

(21) Appl. No.: 17/740,172

(22) Filed: May 9, 2022

(65) Prior Publication Data

US 2022/0380152 A1 Dec. 1, 2022

(30) Foreign Application Priority Data

May 26, 2021 (JP) ..... 2021-088470

(51) Int. Cl.
*B65H 3/06* (2006.01)
*B65H 3/52* (2006.01)
*B65H 5/06* (2006.01)

(52) U.S. Cl.
CPC ..... *B65H 3/0669* (2013.01); *B65H 3/0661* (2013.01); *B65H 3/0684* (2013.01); *B65H 3/5261* (2013.01); *B65H 5/062* (2013.01); *B65H 2403/72* (2013.01); *B65H 2403/73* (2013.01); *B65H 2403/80* (2013.01); *B65H 2404/1441* (2013.01); *B65H 2404/1521* (2013.01); *B65H 2801/06* (2013.01)

(58) Field of Classification Search
CPC ..... B65H 3/5261; B65H 3/5284; B65H 2403/72; B65H 2403/722; B65H 2403/73; B65H 2403/80; B65H 3/06; B65H 3/0607; B65H 3/0669; B65H 3/0661; B65H 5/062
USPC ..... 271/10.04, 10.13
See application file for complete search history.

(56) References Cited

U.S. PATENT DOCUMENTS 9,181,051 B2 * 11/2015 Lee ..... B65H 3/5215

FOREIGN PATENT DOCUMENTS

JP 2007230666 A 9/2007
JP 2019116367 A 7/2019

* cited by examiner

*Primary Examiner* — Jeremy R Severson
(74) *Attorney, Agent, or Firm* — CANON U.S.A., INC. IP Division

(57) ABSTRACT

A sheet feeding device includes a tray, a feeding member, a conveying member, a separation member, a transmission unit, and a biasing member. The separation member abuts the conveying member and separates a single sheet from sheets fed by the feeding member. The transmission unit includes first and second portions respectively having first and second transmission surfaces. Where the first and second transmission surfaces abut each other, the first portion drives the second portion that drives the feeding member. The biasing member biases either of the first and second portions so that the first and second transmission surfaces move away from each other. The conveying member is driven in a state where the separation member abuts the conveying member and the feeding member abuts the sheet stacked on the tray and is stopped. Thereafter, the first and second transmission surfaces abut each other, and the feeding member is driven.

14 Claims, 12 Drawing Sheets

SHEET FEEDING DEVICE AND IMAGE FORMING APPARATUS

BACKGROUND

Field

The present disclosure relates to a sheet feeding device and an image forming apparatus including a sheet feeding device.

Description of the Related Art

In a sheet feeding device that feeds a sheet, a configuration for separating a single sheet from a plurality of sheets is employed to prevent a plurality of sheets from being fed. The publication of Japanese Patent Application Laid-Open No. 2019-116367 discusses a sheet feeding device which includes a conveying member that conveys a sheet and a separation member that abuts the conveying member, and in which the separation member separates a single sheet from a plurality of sheets.

In a sheet feeding device including a conveying member that conveys a sheet and a separation member that abuts the conveying member, it may take time from when the driving of the conveying member is started to when the separation member exerts a desired separation function (the function of separating a single sheet from a plurality of sheets).

SUMMARY

The present disclosure is directed to preventing a sheet from being conveyed toward a nip portion formed by a separation member and a conveying member before the separation member exerts a desired function.

A configuration/component(s) according to the present disclosure is(are) as follows.

According to an aspect of the present disclosure, a sheet feeding device includes a tray on which a sheet is to be stacked, a feeding member configured to feed the sheet stacked on the tray, a conveying member configured to convey the sheet fed by the feeding member, a separation member configured to abut the conveying member and separate a single sheet from a plurality of sheets fed by the feeding member, a transmission unit configured to transmit a driving force to the conveying member and the feeding member, wherein the transmission unit includes a first portion having a first transmission surface and includes a second portion configured to drive the feeding member and having a second transmission surface and, in case where the first and second transmission surfaces abut each other, the first portion drives the second portion, and a biasing member configured to bias either of the first and second portions so that the first and second transmission surfaces move away from each other, wherein (i) the conveying member is driven in a state where the separation member abuts the conveying member and the feeding member abuts the sheet stacked on the tray and is stopped, and (ii) after the conveying member is driven, the first and second transmission surfaces abut each other, and the feeding member is driven.

Further features of the present disclosure will become apparent from the following description of exemplary embodiments with reference to the attached drawings.

DESCRIPTION OF THE EMBODIMENTS

With reference to the drawings, the modes for carrying out this disclosure will be described in detail in an illustrative manner below. However, the dimensions, the materials, the shapes, and the relative arrangement of components described in these exemplary embodiments should be appropriately changed according to the configuration of an apparatus to which the disclosure is applied, or various conditions. The scope of the disclosure is not limited to the following exemplary embodiments.

Image Forming Apparatus

Figure 1:
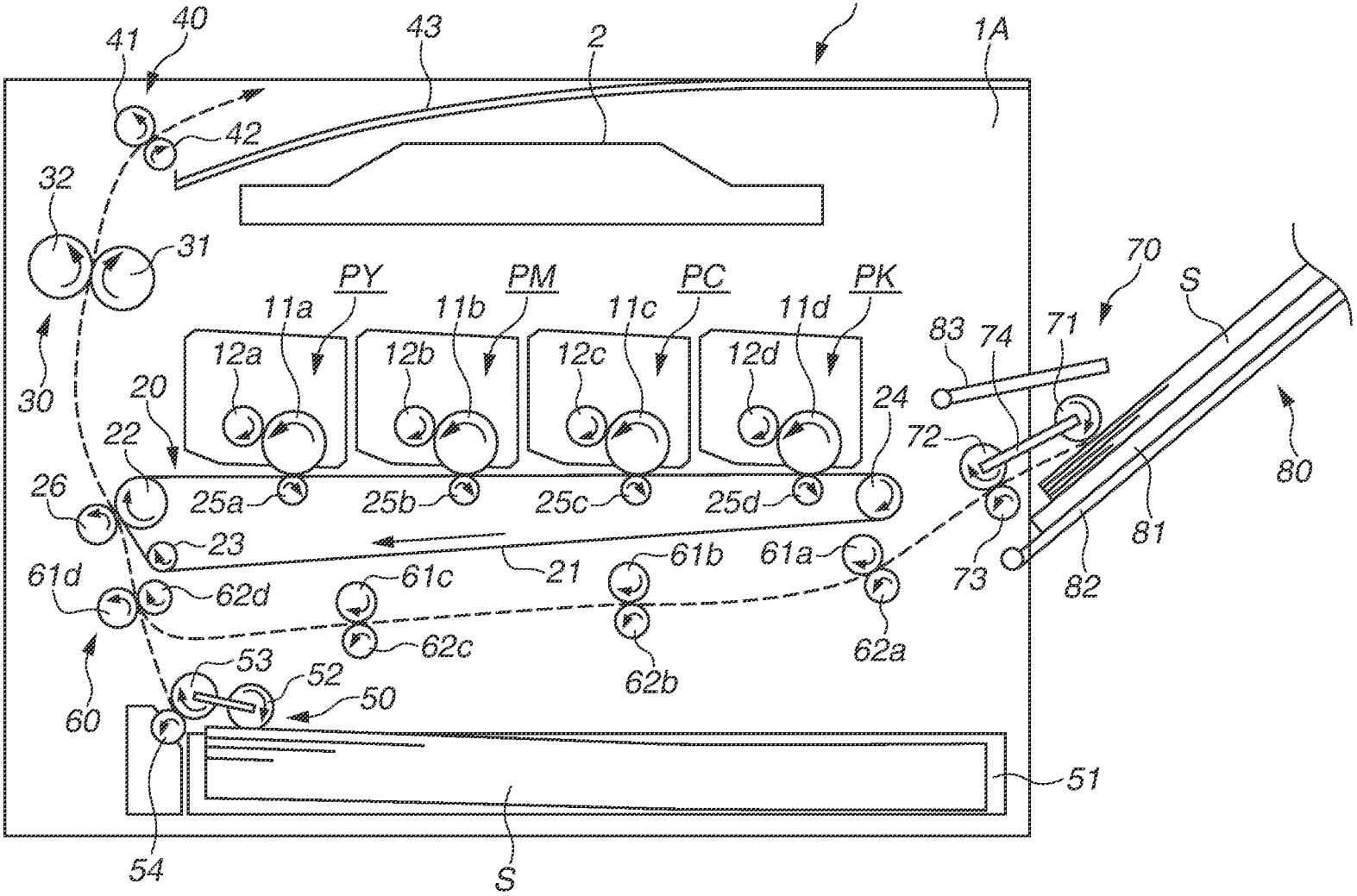
FIG. 1 is a cross-sectional view illustrating a configuration of an image forming apparatus.

With reference to FIG. 1, an image forming apparatus 1 according to the present exemplary embodiment is described. FIG. 1 is a cross-sectional view illustrating the structure of the image forming apparatus 1 according to the present exemplary embodiment. As an example of the image forming apparatus 1 according to the present exemplary embodiment, FIG. 1 illustrates a laser beam printer that forms a color image on a sheet S as a recording material.

The image forming apparatus 1 has an apparatus main body 1A as a housing. Within the apparatus main body 1A, a first process cartridge PY, a second process cartridge PM, a third process cartridge PC, and a fourth process cartridge PK are placed next to each other in an approximately horizontal direction as an image forming unit.

Each of the first process cartridge PY, the second process cartridge PM, the third process cartridge PC, and the fourth process cartridge PK includes a photosensitive drum as an image bearing member that bears an electrostatic latent image, and a developing roller as a developing member that develops the electrostatic latent image formed on the photosensitive drum. The developing roller has a function as a developer bearing member that bears toner as a developer.

The first process cartridge PY includes a photosensitive drum 11*a* and a developing roller 12*a* and is configured to form a yellow image. The second process cartridge PM includes a photosensitive drum 11*b* and a developing roller 12*b* and is configured to form a magenta image. The third process cartridge PC includes a photosensitive drum 11*c* and a developing roller 12*c* and is configured to form a cyan image. The fourth process cartridge PK includes a photosensitive drum 11*d* and a developing roller 12*d* and is configured to form a black image.

The first process cartridge PY, the second process cartridge PM, the third process cartridge PC, and the fourth process cartridge PK include charging members (not illustrated) that charge the photosensitive drums 11*a*, 11*b*, 11*c*, and 11*d*, respectively.

In the present exemplary embodiment, the first process cartridge PY, the second process cartridge PM, the third process cartridge PC, and the fourth process cartridge PK have configurations similar to each other except for the colors of stored toner.

Above the first process cartridge PY, the second process cartridge PM, the third process cartridge PC, and the fourth process cartridge PK, a scanner unit 2 is placed as an exposure device. The scanner unit 2 emits laser light toward each of the charged photosensitive drums 11*a* to 11*d* based on image information. As a result, an electrostatic latent image is formed on each of the photosensitive drums 11*a* to 11*d*. These electrostatic latent images are developed by the developing rollers 12*a* to 12*d*. As the exposure device, for example, an exposure device using a light-emitting diode can be used.

The image forming apparatus 1 includes an intermediate transfer unit 20 placed below the first process cartridge PY, the second process cartridge PM, the third process cartridge PC, and the fourth process cartridge PK. The intermediate transfer unit 20 includes an intermediate transfer belt 21, a driving roller 22, a driven roller 23, and a tension roller 24. The intermediate transfer belt 21 is stretched around the driving roller 22, the driven roller 23, and the tension roller 24 and rotated in the direction of an arrow in FIG. 1 by the driving roller 22.

The lower surfaces of the photosensitive drums 11*a* to 11*d* are in contact with the upper surface of the intermediate transfer belt 21. Inside the intermediate transfer belt 21, primary transfer rollers (25*a*, 25*b*, 25*c*, and 25*d*) as primary transfer members are placed. Between the photosensitive drums 11*a* to 111*d* and the primary transfer rollers 25*a* to 25*d*, respectively, primary transfer units are formed. The photosensitive drums 11*a* to 11*d* and the primary transfer rollers 25*a* to 25*d*, respectively, are adjacent to each other across the intermediate transfer belt 21. In other words, the photosensitive drums 11*a* to 11*d* and the primary transfer rollers 25*a* to 25*d*, respectively, are opposed to each other through the intermediate transfer belt 21. Predetermined voltages are applied to the primary transfer rollers 25*a* to 25*d*, whereby the photosensitive drums 11*a* to 11*d* transfer toner images to the intermediate transfer belt 21.

The image forming apparatus 1 includes a secondary transfer roller 26 that abuts the intermediate transfer belt 21. Between the secondary transfer roller 26 and the driving roller 22, a secondary transfer unit is formed. The secondary transfer roller 26 and the driving roller 22 are adjacent to each other across the intermediate transfer belt 21. In other words, the secondary transfer roller 26 and the driving roller 22 are opposed to each other through the intermediate transfer belt 21. A predetermined voltage is applied to the secondary transfer roller 26, whereby the toner image is transferred from the intermediate transfer belt 21 to the sheet S in the secondary transfer unit.

That is, the process cartridges PY, PM, PC, and PK and the intermediate transfer unit 20 have a function as an image forming unit that forms an image on the sheet S.

The image forming apparatus 1 includes a fixing device 30 and a discharge roller pair 40 as a discharge device. The fixing device 30 and the discharge roller pair 40 are placed above the secondary transfer unit. Further, in an upper portion of the apparatus main body 1A, a discharge tray 43 is provided. The fixing device 30 includes a fixing film 31 and a pressure roller 32. The fixing film 31 and the pressure roller 32 heat and pressurize the sheet S, thereby fixing the toner image to the sheet S. The discharge roller pair 40 includes a discharge roller 41 and a driven member 42. The sheet S to which the toner image is fixed is discharged to the discharge tray 43 by the discharge roller pair 40.

The image forming apparatus 1 according to the present exemplary embodiment includes feeding devices 50 and 70 as feeding devices that feed the sheet S. The feeding device 50 is a tray (cassette) feeding device accommodated in the apparatus main body 1A. The feeding device 70 is a manual feeding tray feeding device.

First, a description is given of a configuration in which the sheet S is fed from the feeding device 50. The feeding device 50 includes a holding tray 51, a pick roller 52, a feed roller 53, and a separation roller 54 that abuts the feed roller 53.

The sheet S stacked on the holding tray 51 is fed by the pick roller 52. If a plurality of sheets S is fed, a single sheet S is separated from the plurality of sheets S in a separation nip formed between the feed roller 53 and the separation roller 54 and is conveyed.

The image forming apparatus 1 includes a conveying roller pair 60 including a conveying roller 61*d* and a driven roller 62*d*. In a nip portion formed by the conveying roller 61*d* and the conveyance driven roller 62*d*, the skew of the sheet S is corrected, and the sheet S is conveyed toward the secondary transfer unit by the conveying roller 61*d*. The sheet S passes through the secondary transfer unit and the fixing device 30 and is discharged to the discharge tray 43 by the discharge roller pair 40.

Next, a case is described where the sheet S is fed from the feeding device 70. The image forming apparatus 1 includes a door unit 80 configured to be openable and closable relative to the apparatus main body 1A. The door unit 80 includes a door 82 and a stacking tray 81 on which the sheet S is stacked.

The feeding device 70 includes the stacking tray 81, a pick roller (pickup roller, feeding member, feeding roller) 71, a feed roller (conveying member, conveying roller) 72, and a separation roller 73. The image forming apparatus 1 includes a cover 83 that covers the pick roller 71.

The pick roller 71 is configured to feed the sheet S stacked on the stacking tray 81. The pick roller 71 is configured to convey the sheet S stacked on the stacking tray 81 toward the feed roller 72.

The feed roller 72 is configured to convey the sheet S fed by the pick roller 71 to a conveying path of the apparatus main body 1A. The separation roller 73 can abut the feed roller 72 and is configured to separate a single sheet S from a plurality of sheets S fed by the pick roller 71. Although the separation roller 73 is used as a separation member in the present exemplary embodiment, a separation pad can also be used as the separation member.

The sheet S stacked on the stacking tray 81 is fed by the pick roller 71. If a plurality of sheets S is fed, a single sheet S is separated from the plurality of sheets S in a separation nip formed between the feed roller 72 and the separation roller 73 and is conveyed.

On the other hand, the image forming apparatus 1 includes conveying rollers 61*a*, 61*b*, and 61*c* and driven rollers 62*a*, 62*b*, and 62*c*. The sheet S is conveyed toward the conveying roller pair 60 by the conveying rollers 61*a*, 61*b*, and 61*c*. In the nip portion formed by the conveying roller 61*d* and the driven roller 62*d*, the skew of the sheet S is corrected, and the sheet S is conveyed toward the secondary transfer unit by the conveying roller 61*d*. The sheet S passes through the secondary transfer unit and the fixing device 30 and is discharged to the discharge tray 43 by the discharge roller pair 40.

Configuration of Feeding Device

Figure 2:
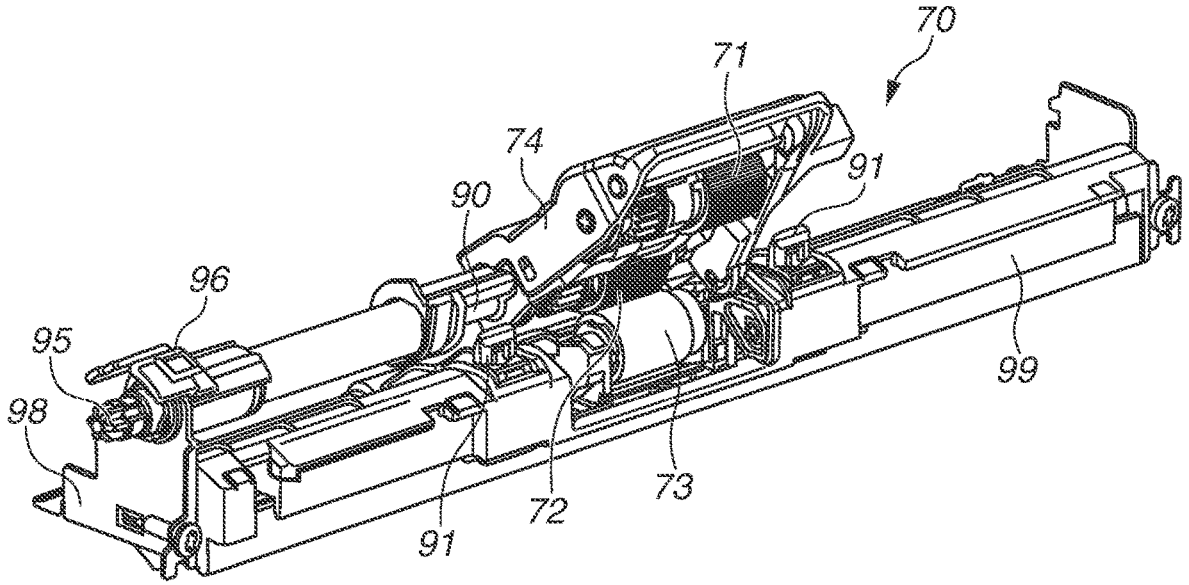
FIG. 2 is a perspective view of a feeding device.

With reference to FIG. 2, the configuration and the feeding operation of the feeding device 70 according to the present exemplary embodiment are described.

FIG. 2 is a perspective view of the feeding device 70 according to the present exemplary embodiment. In FIG. 2, the stacking tray 81 is omitted.

As illustrated in FIG. 2, the feeding device 70 includes the pick roller 71 that feeds the sheet S.

The feeding device 70 also includes the feed roller 72 that conveys the fed sheet S to the conveying path, and the separation roller 73 that is opposed to the feed roller 72 and prevents a plurality of sheets S from being conveyed to the conveying path. The separation roller 73 is configured to be rotatable and includes a torque limiter (not illustrated) within the separation roller 73. The torque limiter within the separation roller 73 has a function as a brake that increases the rotational load of the separation roller 73.

In the present exemplary embodiment, the separation roller 73 is configured to be movable to an abutment position where the separation roller 73 abuts the feed roller 72, and a retracted position where the separation roller 73 is retracted from the abutment position. When the separation roller 73 is at the retracted position, a space larger than the thickness of the sheet S occurs between the separation roller 73 and the feed roller 72. The retracted position can also be said to be a separate position where the separation roller 73 is separate from the feed roller 72. The separation roller 73 moves to the retracted position in the state where the sheet S is being conveyed by the conveying roller 61*a*, thereby preventing tension from acting on the sheet S and also preventing the separation roller 73 from deteriorating. The feed roller 72 rotates in the state where the separation roller 73 is at the abutment position, whereby the separation function of the separation roller 73 is exerted.

The feeding device 70 includes returning members 91 that return the sheet S from a portion between the separation roller 73 and the feed roller 72 toward the stacking tray 81 when the separation roller 73 is located at the retracted position. In the present exemplary embodiment, a plurality of returning members 91 is placed. Specifically, the returning members 91 are placed on both sides of the separation roller 73.

The returning members 91 retract from the conveying path in conjunction with the operation in which the separation roller 73 abuts the feed roller 72 (the operation in which the separation roller 73 moves from the retracted position to the abutment position). The returning members 91 also protrude to the conveying path in conjunction with the operation in which the separation roller 73 retracts from the feed roller 72 (the operation in which the separation roller 73 moves from the abutment position to the retracted position). The returning members 91 are configured to control the position of the front end of the sheet S by abutting the front end of the sheet S.

The distance between the two returning members 91 is set so that the returning members 91 can abut the sheet S having the smallest size among sizes of sheets S that can be fed by the feeding device 70. A mechanism for causing the separation roller 73 and the returning members 91 to operate in conjunction with each other and a conveyance guide 99 forming the conveying path are fixed to the apparatus main body 1A via a conveyance guide frame 98.

Configurations of Returning Members and Separation Roller

With reference to FIGS. 3A, 3B, 4A, and 4B, the configurations of the returning members 91 and the separation roller 73 are described.

Figure 3A:
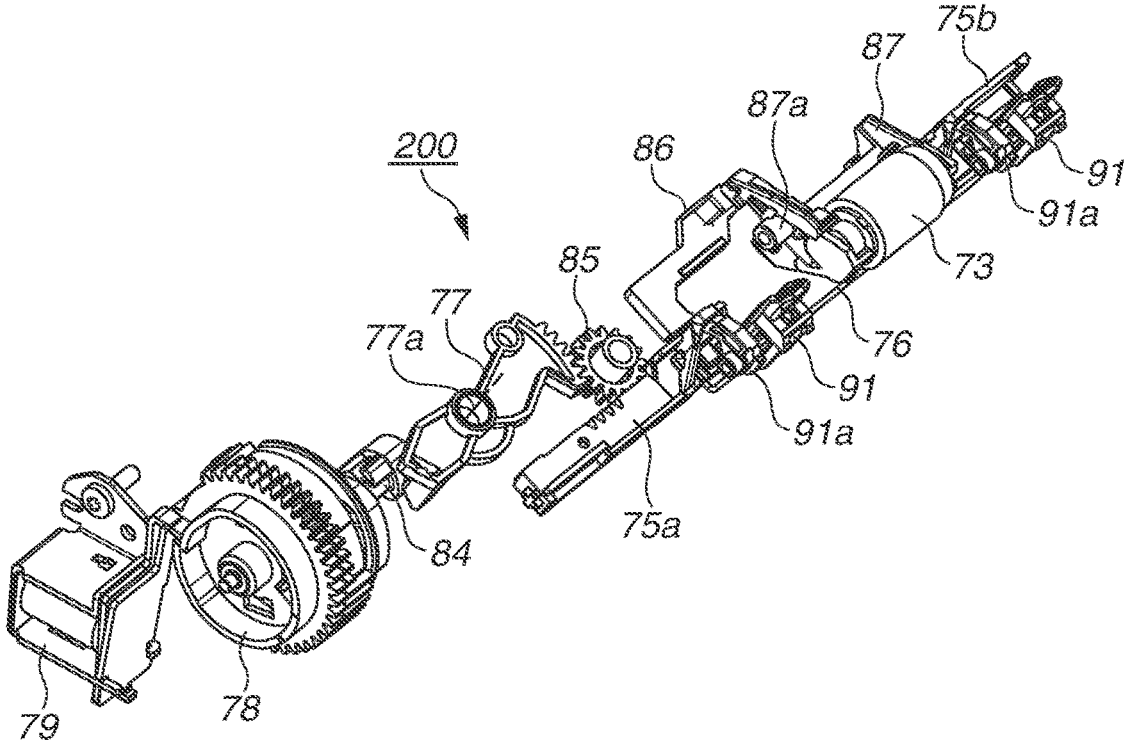
FIG. 3A is a perspective view illustrating a structure of a movement device that moves a separation roller and returning members.
Figure 3B:
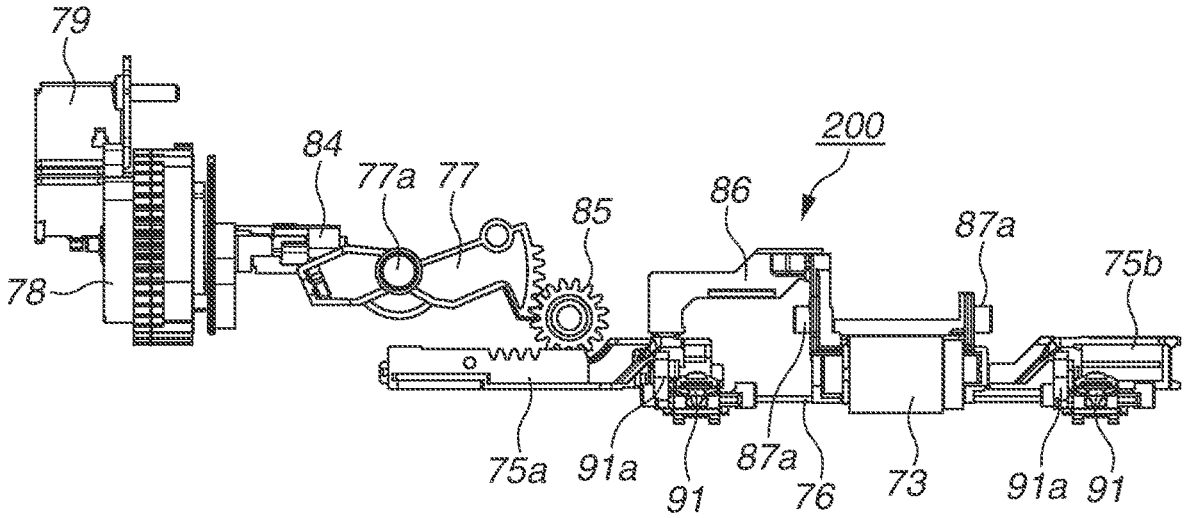
FIG. 3B is a top view illustrating the structure of the movement device that moves the separation roller and the returning members.
Figure 4A:
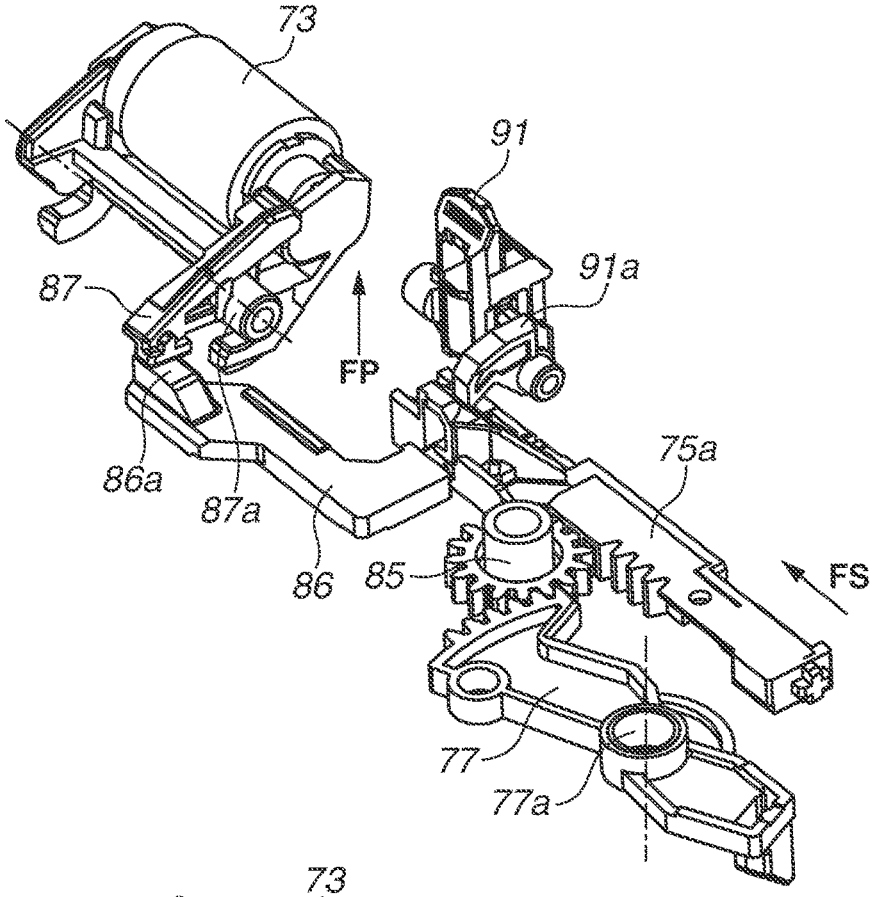
FIG. 4A is a diagram illustrating a state where the separation roller separates from a feed roller and one of the returning members protrudes.
Figure 4B:
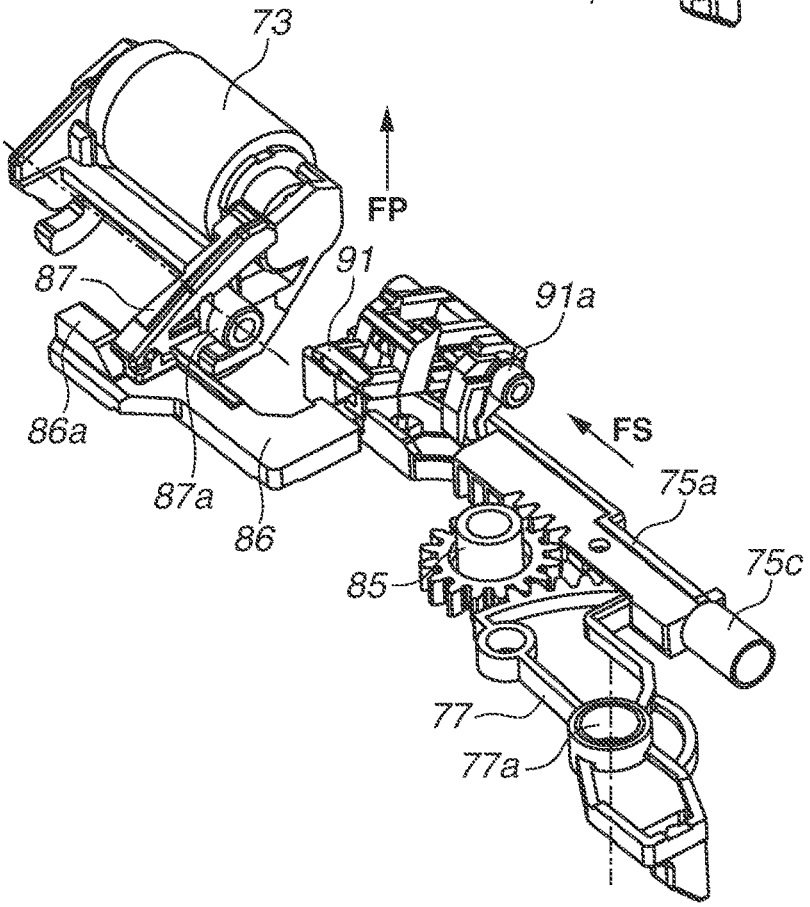
FIG. 4B is a diagram illustrating a state where the separation roller abuts the feed roller and the returning member retracts.

FIGS. 3A and 3B are diagrams illustrating the structure of a movement device 200 that moves the separation roller 73 and the returning members 91. FIG. 3A is a perspective view illustrating the structure of the movement device 200 that moves the separation roller 73 and the returning members 91. FIG. 3B is a top view illustrating the structure of the movement device 200 that moves the separation roller 73 and the returning members 91. FIGS. 4A and 4B are diagrams illustrating the movements of the separation roller 73 and one of the returning members 91. FIG. 4A is a diagram illustrating the state where the separation roller 73 separates from the feed roller 72 and the returning member 91 protrudes. FIG. 4B is a diagram illustrating the state where the separation roller 73 abuts the feed roller 72 and the returning member 91 retracts.

The apparatus main body 1A of the image forming apparatus 1 includes the movement device 200 that moves the separation roller 73 and the returning members 91. The movement device 200 can be said to be a part of the feeding device 70. The movement device 200 includes a solenoid 79, a snaggletooth gear 78, a control cam 84, a reciprocating gear 77, an idler gear 85, a first movement member 75*a*, a holder supporting member 86, a second movement member 75*b*, a linking member 76, and a roller holder 87. The first movement member 75*a* and the second movement member 75*b* are linked together by the linking member 76 and configured to integrally move. Further, the holder supporting member 86 is linked to the first movement member 75*a*. The first movement member 75*a* and the holder supporting member 86 are configured to integrally move.

The snaggletooth gear 78 receives a driving force from a motor M (see FIG. 12) as a driving source provided in the apparatus main body 1A. More specifically, the snaggletooth gear 78 is configured to mesh with a driving gear (not illustrated) driven by the motor M and receive a driving force transmitted from the driving gear.

The solenoid 79 includes a restriction portion that restricts the snaggletooth gear 78. The restriction portion of the solenoid 79 restricts the snaggletooth gear 78 so that a snaggletooth portion of the snaggletooth gear 78 is opposed to the driving gear. The snaggletooth gear 78 is configured to, if the solenoid 79 operates and the restriction of the snaggletooth gear 78 by the restriction portion is lifted, mesh with the driving gear and receive a driving force from the driving gear. Every time the solenoid 79 operates once, the snaggletooth gear 78 rotates once, and a single sheet S is conveyed. After the snaggletooth gear 78 rotates once, the restriction portion of the solenoid 79 restricts the snaggletooth gear 78.

In the image forming apparatus 1 according to the present exemplary embodiment, the feeding devices 50 and 70 are driven by the common motor M. Thus, only if the sheet S is conveyed from the feeding device 70, the solenoid 79 operates, and the sheet S is conveyed from the feeding device 70.

Next, a description is given of a configuration for causing the separation roller 73 and the returning members 91 to operate in conjunction with each other.

The movement device 200 includes engagement portions 91*a* that engage with the returning members 91. The first movement member 75*a* and the second movement member 75*b* support the respective engagement portions 91*a* so that the returning members 91 protrude toward the conveying path.

As illustrated in FIG. 4A, the roller holder 87 holding the separation roller 73 is configured to be rotatable about a swing shaft 87*a*. The roller holder 87 receives from a biasing member (not illustrated) a force FP acting in the direction in which the separation roller 73 comes close to the feed roller 72. The holder supporting member 86 includes a supporting portion 86*a*. In the state illustrated in FIG. 4A, the roller holder 87 is supported by the supporting portion 86*a*, whereby the separation roller 73 is located at the retracted position against the force FP.

The first movement member 75*a* receives a force FS using a biasing member 75*c* attached to the first movement member 75*a*. On the other hand, the control cam 84 is attached to the snaggletooth gear 78.

In the state illustrated in FIGS. 3A, 3B, and 4A, the reciprocating gear 77 is restricted by the control cam 84. If the reciprocating gear 77 is pressed by the control cam 84, the reciprocating gear 77 swings about a swing shaft 77*a*. The movement of the reciprocating gear 77 is transmitted to the first movement member 75*a* via the reciprocating idler gear 85. As a result, as illustrated in FIGS. 3A, 3B, and 4A, the first movement member 75*a* and the second movement member 75*b* are held against the force FS in the state where the first movement member 75*a* and the second movement member 75*b* are moved in an opposite direction to the force FS.

If the solenoid 79 operates, the control cam 84 rotates with the rotation of the snaggletooth gear 78, and the control cam 84 moves away from the reciprocating gear 77. As a result, as illustrated in FIG. 4B, the biasing member 75*c* moves the first movement member 75*a*, the second movement member 75*b*, and the holder supporting member 86 in the direction of the force FS. In this state, the roller holder 87 moves away from the supporting portion 86*a* and swings about the swing shaft 87*a*. Then, the separation roller 73 is located at the abutment position by the force FP.

In the state illustrated in FIG. 4A, a supporting portion of the first movement member 75*a* that supports the engagement portion 91*a* moves away from the engagement portion 91*a*. As a result, the returning member 91 retracts.

With the above configuration, the start of the operation of causing the separation roller 73 and the returning member 91 to operate in conjunction with each other is controlled by the solenoid (switching device) 79.

As described above, the movement device 200 has a function as a separation movement portion configured to move the separation roller 73 to the abutment position and the retracted position. The movement device 200 also has a function as a returning member movement portion configured to move the returning member 91 to a protruding position where the returning member 91 protrudes to the conveying path, and a standby position where the returning member 91 is retracted from the conveying path.

The relationships between the second movement member 75*b*, the engagement portion 91*a*, and the returning member 91 are similar to the relationships between the first movement member 75*a*, the engagement portion 91*a*, and the returning member 91. Thus, the movement of the returning member 91 by the second movement member 75*b* is not described.

Configuration of Pick Roller Rise-and-Fall Mechanism

Next, with reference to FIGS. 5, 6, 7, 8A, and 8B, a description is given of a configuration for causing the pick roller 71 to rise and fall. The pick roller 71 is configured to be movable to a first position where the pick roller 71 can abut the sheet S stacked on the stacking tray 81, and a second position where the pick roller 71 is retracted from the first position.

Figure 5:
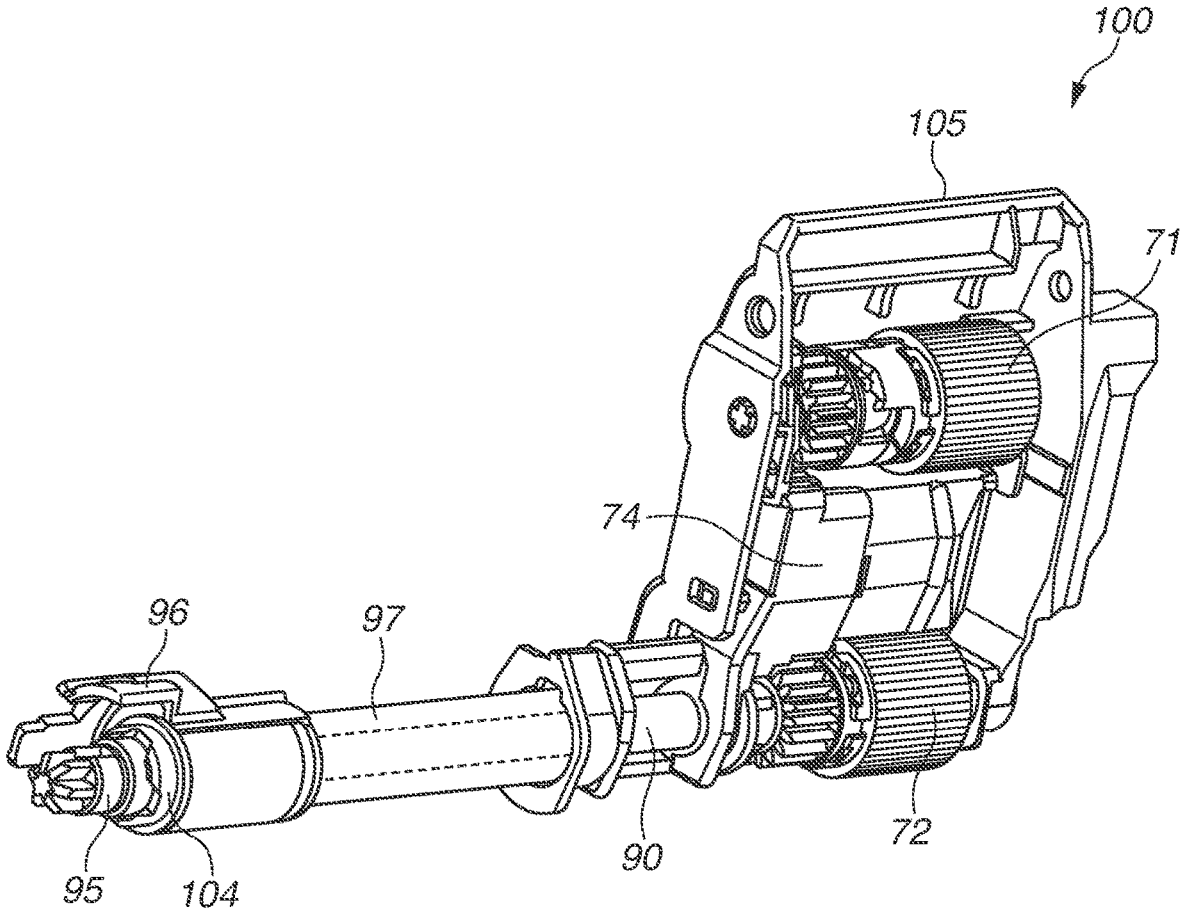
FIG. 5 is a perspective view of a pick feed unit.
Figure 6:
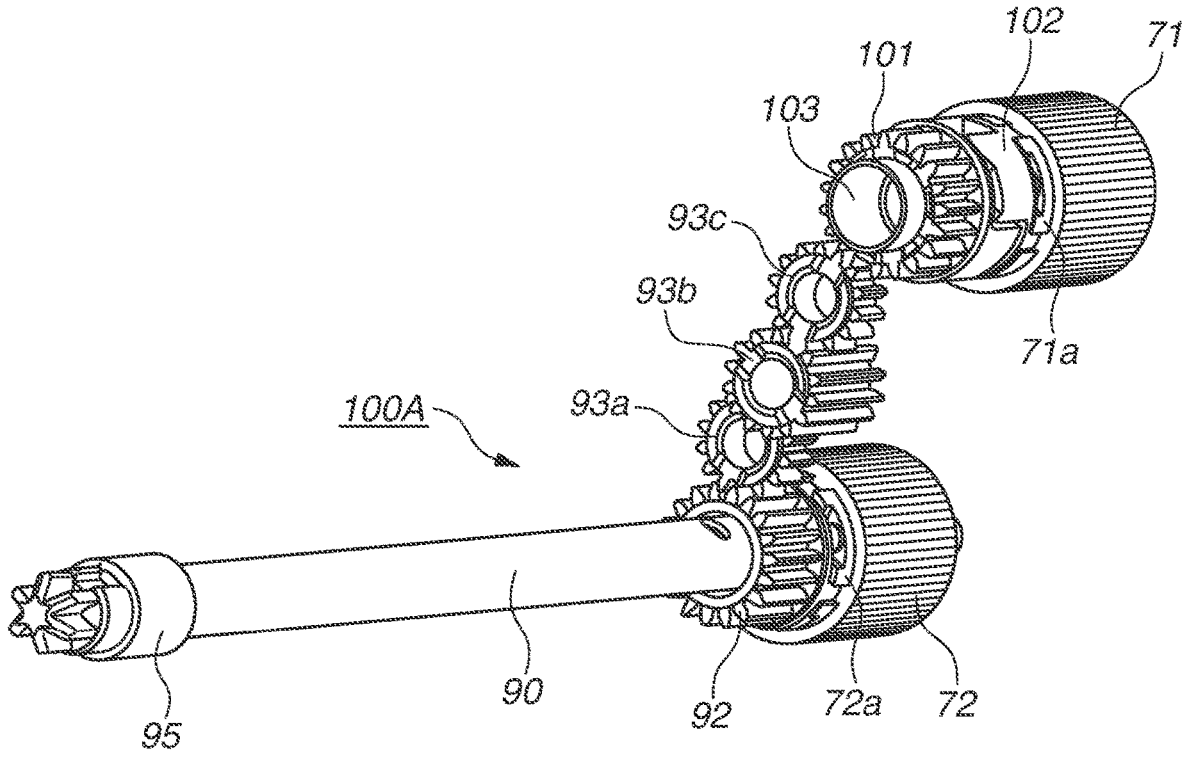
FIG. 6 is a diagram illustrating a configuration for transmitting a driving force to a pick roller and the feed roller.
Figure 7:
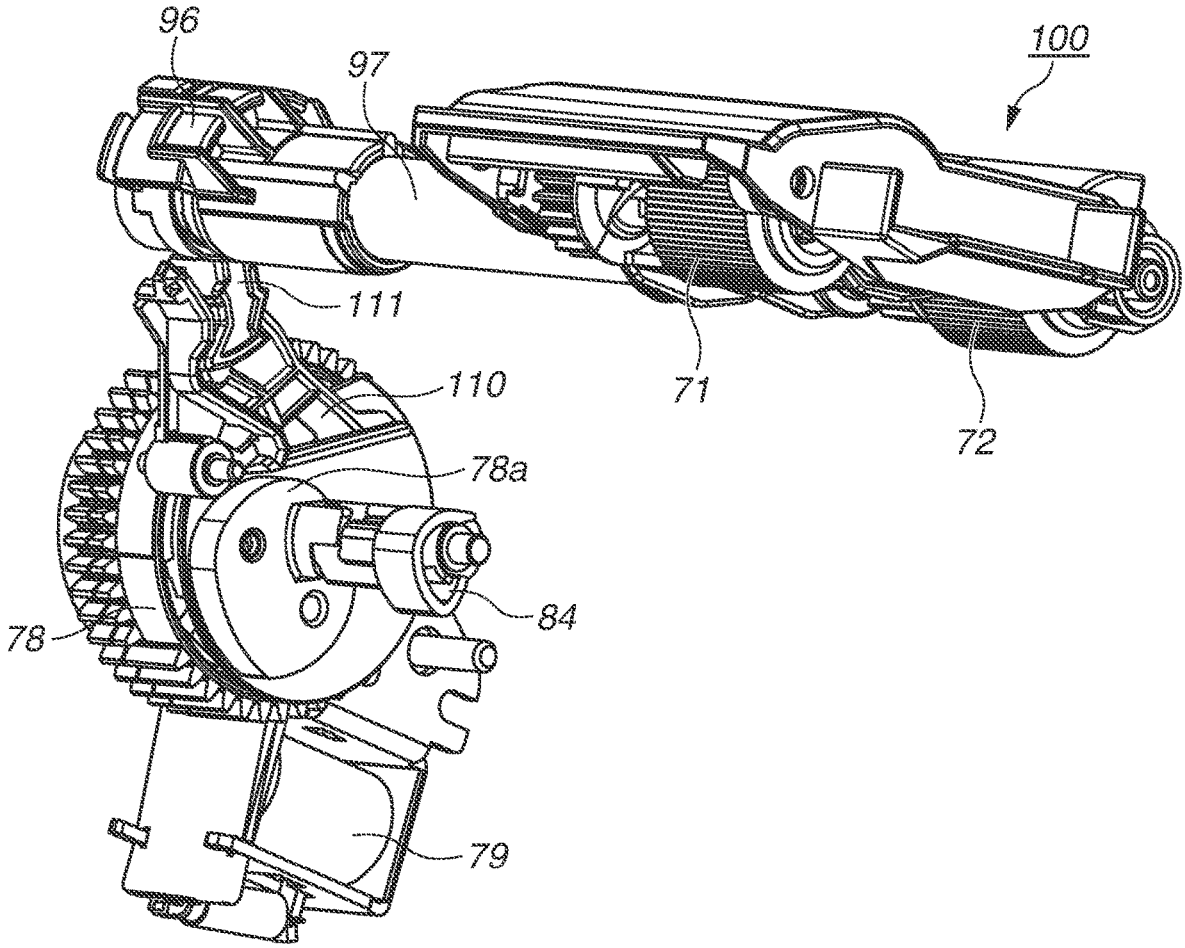
FIG. 7 is a perspective view illustrating a relationship between the pick feed unit and a snaggletooth gear.
Figure 8A:
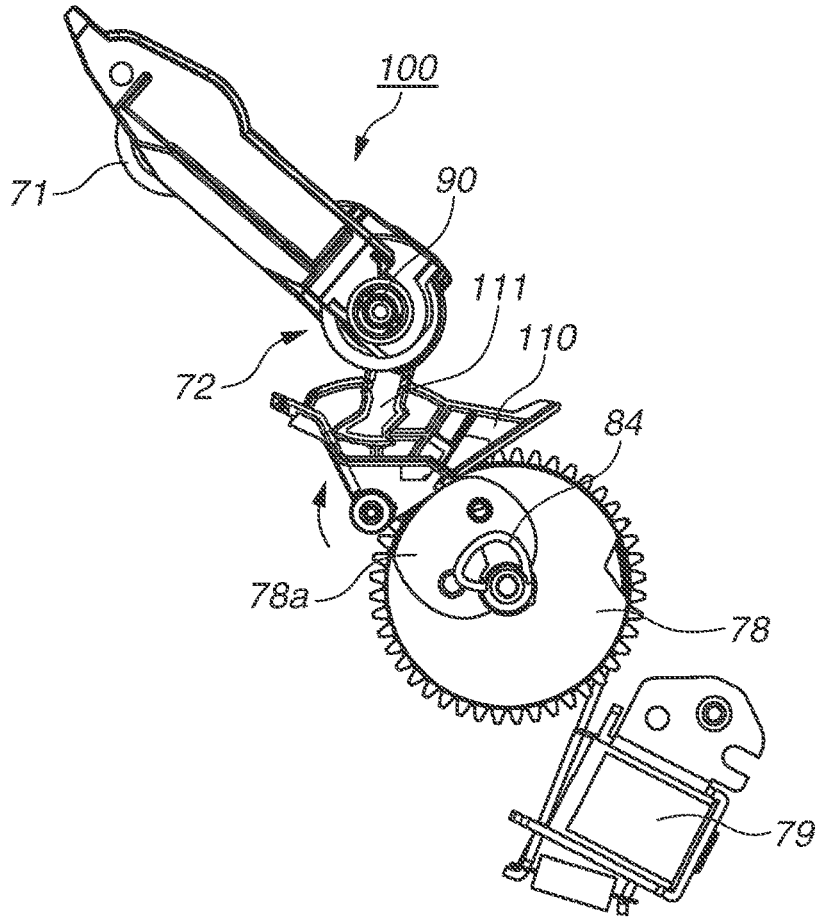
FIG. 8A is a diagram illustrating a state where the pick roller rises.
Figure 8B:
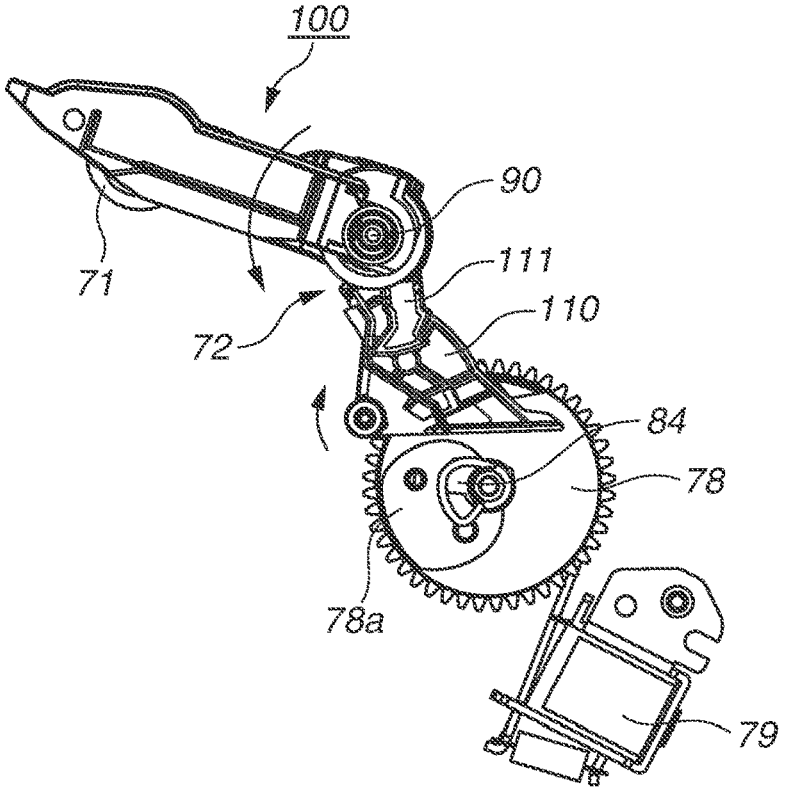
FIG. 8B is a diagram illustrating a state where the pick roller falls.

FIG. 5 is a perspective view of a pick feed unit 100. FIG. 6 is a diagram illustrating a configuration for transmitting a driving force to the pick roller 71 and the feed roller 72. FIG. 7 is a perspective view illustrating the relationship between the pick feed unit 100 and the snaggletooth gear 78. FIGS. 8A and 8B are diagrams illustrating the rise and fall of the pick roller 71. FIG. 8A is a diagram illustrating the state where the pick roller 71 rises. FIG. 8B is a diagram illustrating the state where the pick roller 71 falls.

The feeding device 70 includes a pick feed unit 100. The pick feed unit 100 is configured to be detachable from the apparatus main body 1A. The pick feed unit 100 is swingably supported via a bearing 104 by the conveyance guide frame 98 fixed to the apparatus main body 1A.

The feeding device 70 includes a transmission unit 100A configured to transmit a driving force to the feed roller 72 and the pick roller 71. The transmission unit 100A can be said to be a part of the pick feed unit 100. A driving force is transmitted from the transmission unit 100A, whereby the feed roller 72 and the pick roller 71 rotate, and the sheet S is conveyed from the stacking tray 81.

As illustrated in FIG. 6, the transmission unit 100A includes a feed shaft linking portion 95 that receives a driving force from the snaggletooth gear 78 via a gear meshed with the snaggletooth gear 78, and a roller driving shaft 90 linked to the feed shaft linking portion 95. The transmission unit 100A includes a feed gear 92 that drives the feed roller 72, and idler gears 93*a*, 93*b*, and 93*c*. The feed gear 92 is rotated by the roller shaft 90. Further, the transmission unit 100A includes a pick gear (first portion, force application portion) 101 that receives drive from the feed gear 92 via the idler gears 93*a* to 93*c* and drives the pick roller 71, and a reception portion (pick roller latch, force reception portion, second portion) 102.

As illustrated in FIG. 5, the pick roller 71, the feed roller 72, the feed gear 92, the idler gears 93*a* to 93*c*, the pick gear 101, and the reception portion 102 are held by a rise-and-fall arm (arm) 74 and a roller cover 105. The arm 74 is linked to a cylindrical rise-and-fall arm shaft (arm shaft) 97. To an end portion of the arm shaft 97, an arm linking portion 96 is attached. Within the arm shaft 97, the roller shaft 90 is placed.

As illustrated in FIG. 7, the pick feed unit 100 includes a pressing target portion 111 and a pressing portion 110. The arm linking portion 96 is linked to the pressing target portion 111. The pressing target portion 111 is engaged with the pressing portion 110. In the snaggletooth gear 78, a restriction cam 78*a* that restricts the pressing portion 110 is provided.

As described above, the pick roller 71 is configured to be movable to the first position where the pick roller 71 can abut the sheet S stacked on the stacking tray 81, and the second position where the pick roller 71 is retracted from the first position. More specifically, the pick roller 71 is configured to be swingable about the feed roller 72 between a feeding position (the first position) where the pick roller 71 abuts the sheet S stacked on the stacking tray 81, and a separate position (the second position) where the pick roller 71 is separate from the sheet S.

As illustrated in FIGS. 8A and 8B, the pressing portion 110 is biased clockwise in FIGS. 8A and 8B by a biasing member (not illustrated). When the sheet S is not conveyed from the feeding device 70, then as illustrated in FIG. 8A, the pick roller 71 is located at the second position (a standby position, the separate position) where the pick roller 71 is away from the sheet S stacked on the stacking tray 81. In this state, the position of the pressing portion 110 is restricted by the restriction cam 78*a*.

On the other hand, when the sheet S is conveyed from the feeding device 70, then as illustrated in FIG. 8B, the pick roller 71 is located at the first position (the feeding position, an abutment position) where the pick roller 71 abuts the sheet S stacked on the stacking tray 81. As illustrated in FIG. 8B, if the restriction cam 78*a* moves away from the pressing portion 110, the pressing portion 110 swings clockwise in FIGS. 8A and 8B and presses the pressing target portion 111. Then, the pick roller 71 swings counterclockwise in FIGS. 8A and 8B about the feed roller 72. In this state, the pick roller 71 abuts the sheet S stacked on the stacking tray 81. When the sheet S is not stacked on the stacking tray 81, the pick roller 71 abuts the stacking tray 81.

As described above, every time the solenoid 79 operates, the snaggletooth gear 78 rotates, and a single sheet S is sent. In conjunction with the rotation of the snaggletooth gear 78, the rotations of the pick roller 71 and the feed roller 72, the movement of the pick roller 71 between the first and second positions, the movement of the separation roller 73 between the abutment position and the retracted position, and the movements of the returning members 91 between the protruding position and the standby position are executed. That is, the rotations of the pick roller 71 and the feed roller 72, the movement of the pick roller 71 between the first and second positions, the movement of the separation roller 73 between the abutment position and the retracted position, and the movements of the returning members 91 between the protruding position and the standby position are executed by the common motor M via the snaggletooth gear 78.

Transmission of Drive to Feed Roller and Pick Roller

With reference to FIG. 6, the transmission of drive to the feed roller 72 and the pick roller 71 is described in further detail.

When the feed roller 72 and the pick roller 71 are driven, the feed shaft linking portion 95 is driven by a driving target gear driven by the snaggletooth gear 78. In other words, the feed shaft linking portion 95 receives a driving force from the snaggletooth gear 78. The driving force transmitted to the feed shaft linking portion 95 is transmitted to the feed roller shaft 90 and transmitted to the feed gear 92 linked to the feed roller shaft 90. The driving force transmitted to the feed gear 92 is transmitted to the pick gear 101 via the idler gears 93*a* to 93*c*.

The feed roller 72 includes a rubber holding portion 72*a* that holds a rubber portion. The pick roller 71 includes a rubber holding portion 71*a* that holds a rubber portion. In the present exemplary embodiment, the feed roller 72 and the pick roller 71 have the same shape. Thus, it is possible to use a single type of component as the feed roller 72 and the pick roller 71 and reduce the cost of the feeding device 70.

The rubber holding portion 72*a* and the feed gear 92 are separate components, and the rubber holding portion 71*a* and the reception portion 102 are separate components. Thus, it is possible to use a single type of component as the feed roller 72 and the pick roller 71.

Configuration of Pick Roller Delay Mechanism

The transmission unit 100A according to the present exemplary embodiment includes a drive transmission mechanism (hereinafter, "delay mechanism") 106. The delay mechanism 106 is configured to, after a driving force is transmitted to the pick gear 101, transmit the driving force to the pick roller 71 after a predetermined time interval.

Figure 9A:
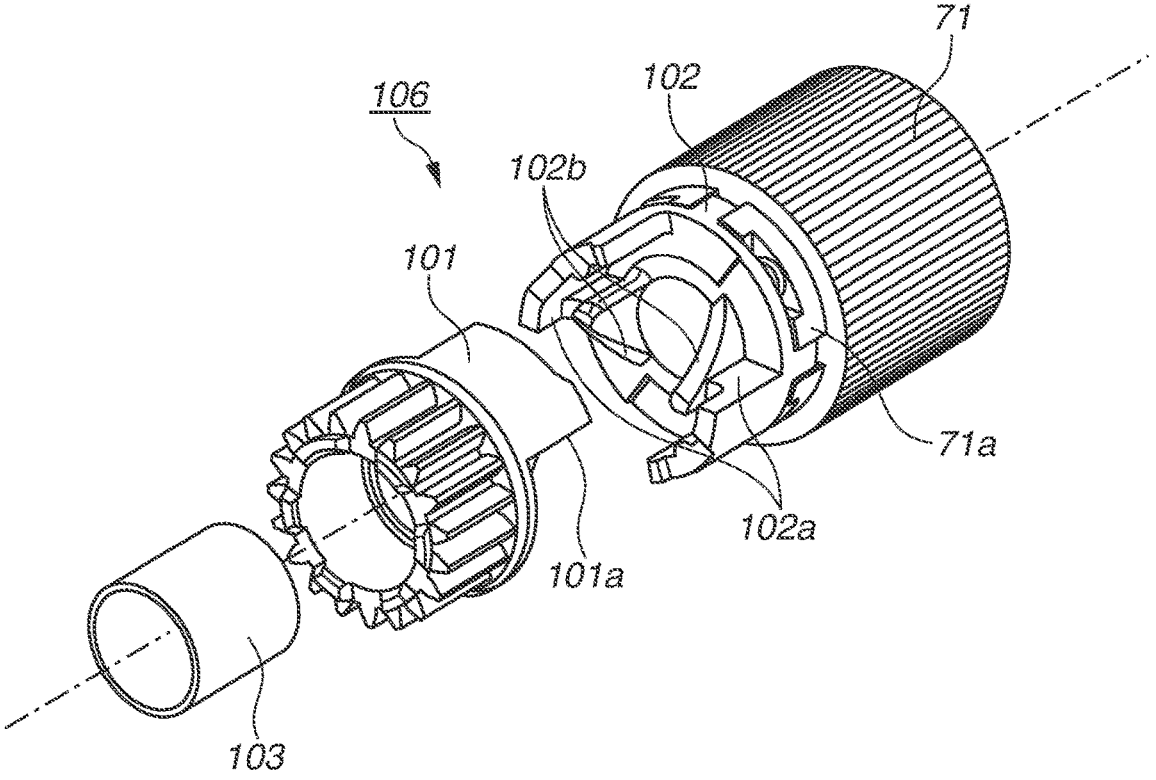
FIG. 9A is a perspective view of a delay mechanism when viewed from one side.
Figure 9B:
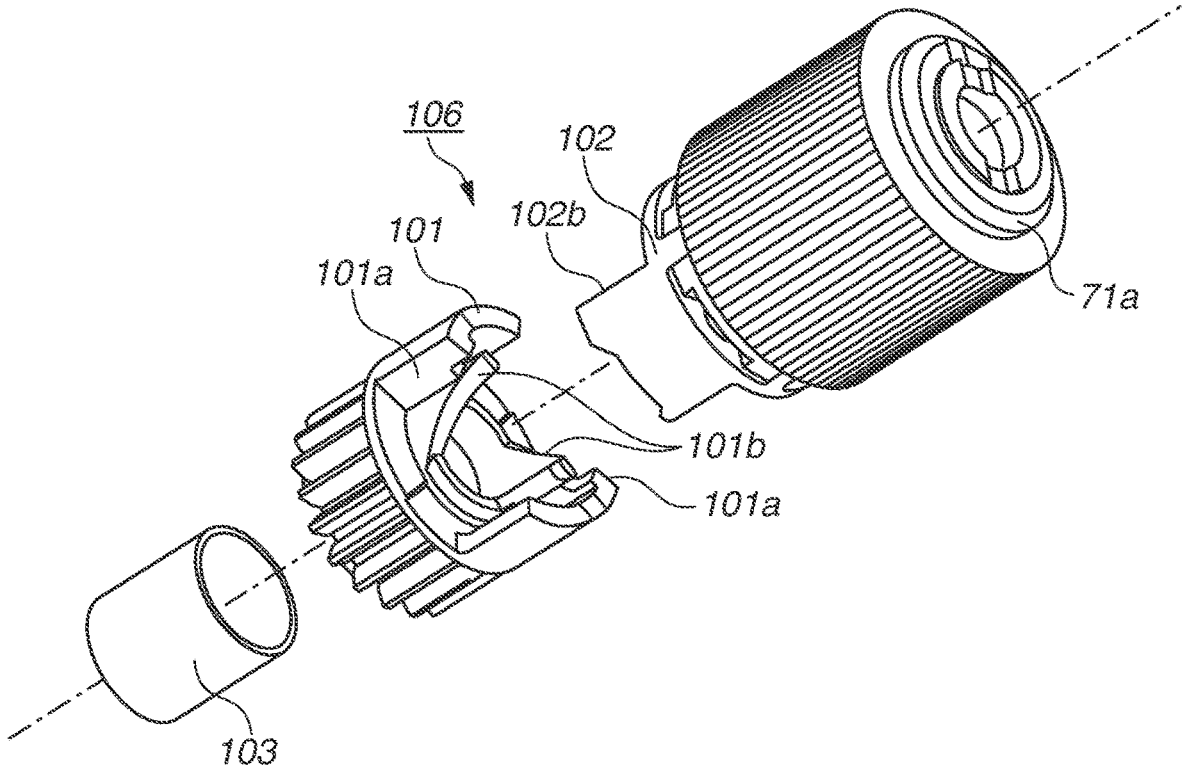
FIG. 9B is a perspective view of the delay mechanism when viewed from another side.
Figure 10:
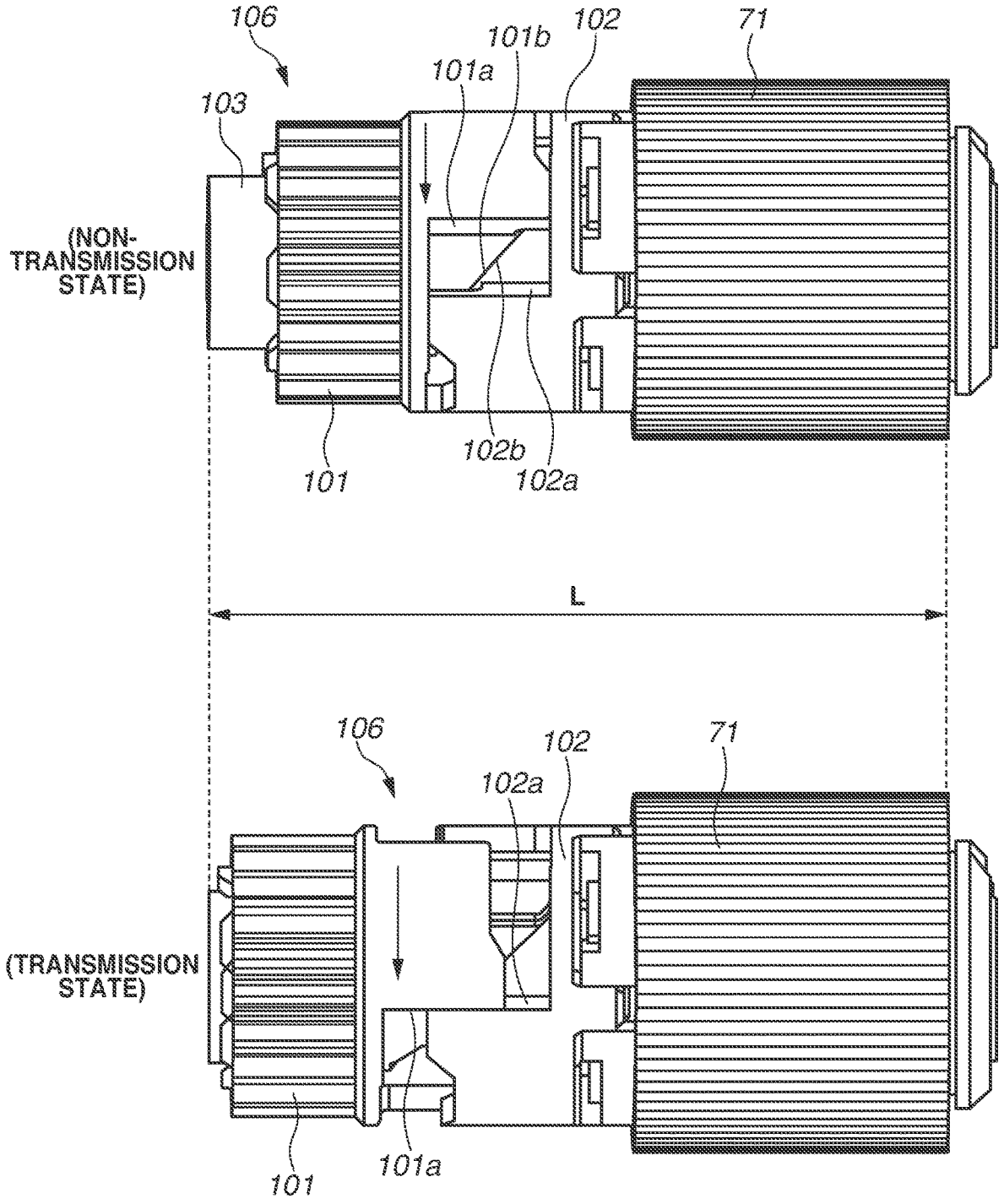
FIG. 10 is a diagram illustrating an operation of the delay mechanism.

With reference to FIGS. 9A, 9B, and 10, the delay mechanism 106 according to the present exemplary embodiment is described.

FIGS. 9A and 9B are diagrams illustrating the delay mechanism 106. FIG. 9A is a perspective view of the delay mechanism 106 when viewed from one side. FIG. 9B is a perspective view of the delay mechanism 106 when viewed from another side. FIG. 10 is a diagram illustrating the operation of the delay mechanism 106.

In the present exemplary embodiment, the delay mechanism 106 includes the pick gear (first portion, force application portion) 101, the reception portion (second portion, force reception portion) 102 driven by the pick gear 101 and configured to drive the pick roller 71, and a spring 103 as a biasing member.

In the present exemplary embodiment, the reception portion 102 is linked to an end portion of the pick roller 71. Specifically, the reception portion 102 is linked to the rubber holding portion 71*a* of the pick roller 71. The pick gear 101 and the reception portion 102 are concentrically held by the arm 74. That is, the rotational axis of the pick gear 101 and the rotational axis of the reception portion 102 coincide with each other. The rotational axis of the pick gear 101, the rotational axis of the reception portion 102, and the rotational axis of the pick roller 71 coincide with each other. In other words, the pick gear 101, the reception portion 102, and the pick roller 71 are configured to rotate about a common rotational axis.

The pick roller 71 abuts the roller cover 105, and an end portion of the spring 103 abuts the arm 74. Thus, as illustrated in FIG. 10, in the rotational axis direction of the pick gear 101, a length L between an end portion of the pick roller 71 and the end portion of the spring 103 is constant.

As illustrated in FIGS. 9A and 9B, the pick gear 101 includes a drive transmission surface (first transmission surface, driving surface) 101*a* and a cam surface (first abutment surface, first sloping surface) 101*b*. In the present exemplary embodiment, a plurality of drive transmission surfaces 101*a* and a plurality of cam surfaces 101*b* are provided. The cam surfaces 101*b* are sloping relative to the rotational axis direction of the pick gear 101. In the present exemplary embodiment, the plurality of drive transmission surfaces 101*a* and the plurality of cam surfaces 101*b* are placed on concentric circles about the rotation center of the pick gear 101.

In the present exemplary embodiment, the drive transmission surfaces 101*a* are located at positions further away from the rotation center of the pick gear 101 than the cam surfaces 101*b* are. The cam surfaces 101*b*, however, may be located at positions further away from the rotation center of the pick gear 101 than the drive transmission surfaces 101*a* are.

As illustrated in FIGS. 9A and 9B, the reception portion 102 includes a drive transmission surface (second transmission surface, driving target surface) 102*a* and a cam surface (second abutment surface, second sloping surface) 102*b*. In the present exemplary embodiment, a plurality of drive transmission surfaces 102*a* and a plurality of cam surfaces 102*b* are provided. The cam surfaces 102*b* are sloping relative to the rotational axis direction of the reception portion 102. In the present exemplary embodiment, the plurality of drive transmission surfaces 102*a* and the plurality of cam surfaces 102*b* are placed on concentric circles about the rotation center of the reception portion 102.

In the present exemplary embodiment, the drive transmission surfaces 102*a* are located at positions further away from the rotation center of the reception portion 102 than the cam surfaces 102*b* are. The cam surfaces 102*b*, however, may be located at positions further away from the rotation center of the reception portion 102 than the drive transmission surfaces 102*a* are.

Two drive transmission surfaces 101*a*, two drive transmission surfaces 102*a*, two cam surfaces 101*b*, and two cam surfaces 102*b* are provided. The number of each portion, however, may be one, or may be greater than two.

The drive transmission surfaces 101*a* abut the drive transmission surfaces 102*a*, whereby a driving force is transmitted from the drive transmission surfaces 101*a* to the drive transmission surfaces 102*a*, and the pick gear 101 drives the reception portion 102.

As a result, if the pick gear 101 rotates, the reception portion 102 and the pick roller 71 rotate.

When the drive transmission surfaces 101*a* and 102*a* are away from each other, a driving force is not transmitted from the drive transmission surfaces 101*a* to the drive transmission surfaces 102*a*. As a result, even if the pick gear 101 rotates, the reception portion 102 and the pick roller 71 do not rotate.

Operation of Pick Roller Delay Mechanism

With reference to FIGS. 9A, 9B, and 10, the operation of the delay mechanism 106 is described.

The spring 103 biases the pick gear 101 so that the drive transmission surfaces 101*a* and 102*a* move away from each other. The pick gear 101 is configured to be movable in a direction away from the reception portion 102 in the rotational axis direction of the pick gear 101. In the present exemplary embodiment, the pick gear 101 is always biased in a direction toward the reception portion 102 by the spring 103 in the rotational axis direction (the thrust direction) of the pick gear 101.

The cam surfaces 101*b* of the pick gear 101 and the cam surfaces 102*b* of the reception portion 102 abut each other by the biasing force of the spring 103. The cam surfaces 101*b* and 102*b* abut each other by the biasing force of the spring 103, whereby the drive transmission surfaces 101*a* and 102*a* separate from each other. Specifically, if the cam surfaces 101*b* and 102*b* receive the biasing force of the spring 103 in the state where the cam surfaces 101*b* and 102*b* are in contact with each other, the cam surfaces 101*b* and 102*b* are sloping so that the drive transmission surfaces 101*a* and 102*a* separate from each other. As a result, as illustrated in the upper diagram of FIG. 10, a predetermined distance is maintained between the drive transmission surfaces 101*a* and 102*a*. That is, the spring 103 biases the pick gear 101 so that the drive transmission surfaces 101*a* and 102*a* move away from each other.

The biasing force of the spring 103 is set to a force capable of maintaining the distance between the drive transmission surfaces 101*a* and 102*a* unless the pick roller 71 abuts the sheet S.

If the pick roller 71 abuts the stacking tray 81 or the sheet S stacked on the stacking tray 81, the rotation of the pick roller 71 is restricted by a frictional force received from the sheet S or the stacking tray 81. Simultaneously, the rotation of the reception portion 102 linked to the pick roller 71 is also restricted.

If the pick gear 101 is driven in this state, the pick gear 101 moves in a direction away from the reception portion 102 (to the left in FIG. 10) in the rotational axis direction of the pick gear 101 against the biasing force of the spring 103. Specifically, the cam surfaces 101*b* slide along the cam surfaces 102*b*, and the pick gear 101 moves. Then, the drive transmission surfaces 101*a* and 102*a* come close to each other in the rotational direction of the pick gear 101, and as illustrated in the lower diagram of FIG. 10, the drive transmission surfaces 101*a* and 102*a* abut each other. As a result, the pick roller 71 abutting the sheet S rotates, and the sheet S is conveyed. That is, the sheet S stacked on the stacking tray 81 is conveyed by the pick roller 71.

If the pick roller 71 separates from the stacking tray 81 or the sheet S stacked on the stacking tray 81, the rotation of the pick roller 71 ceases to be restricted. On the other hand, in the state where the drive transmission surfaces 101*a* and 102*a* abut each other, the cam surfaces 101*b* abut the cam surfaces 102*b*. Thus, if the rotation of the pick roller 71 ceases to be restricted, the cam surfaces 101*b* push the cam surfaces 102*b* by the biasing force of the spring 103, and the drive transmission surfaces 101*a* and 102*a* are separate from each other. The above operation is repeated every time a single sheet S is conveyed, whereby the sheet S is conveyed from the stacking tray 81.

By the delay mechanism 106, the transmission unit 100A can enter a first driving state where the feed roller 72 is driven (rotates) and the pick roller 71 is stopped, and a second driving state where the feed roller 72 is driven (rotates) and the pick roller 71 is driven (rotates).

Conveying Operation of Sheet S

With reference to FIGS. 11A to 11C and 12, a description is given of a conveying operation for conveying the sheet S from the stacking tray 81.

Figure 11A:
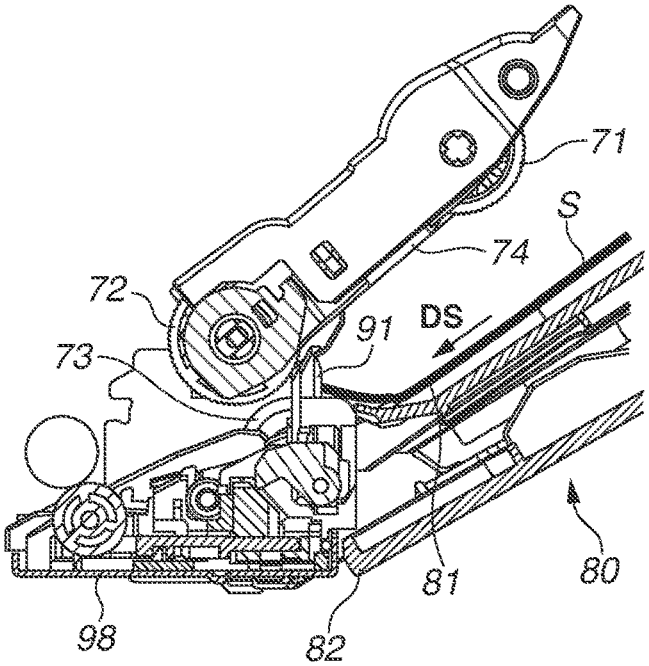
FIG. 11A is a diagram illustrating a state where the pick roller is away from a sheet stacked on a stacking tray.
Figure 11B:
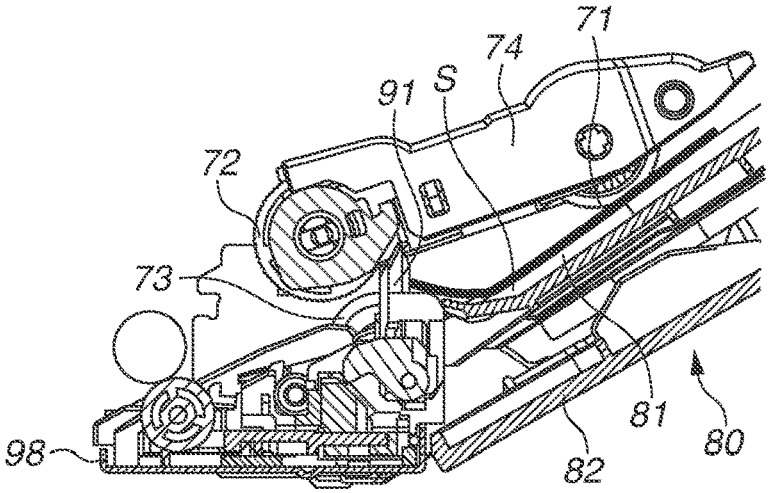
FIG. 11B is a diagram illustrating a state where the pick roller abuts the sheet stacked on the stacking tray.
Figure 11C:
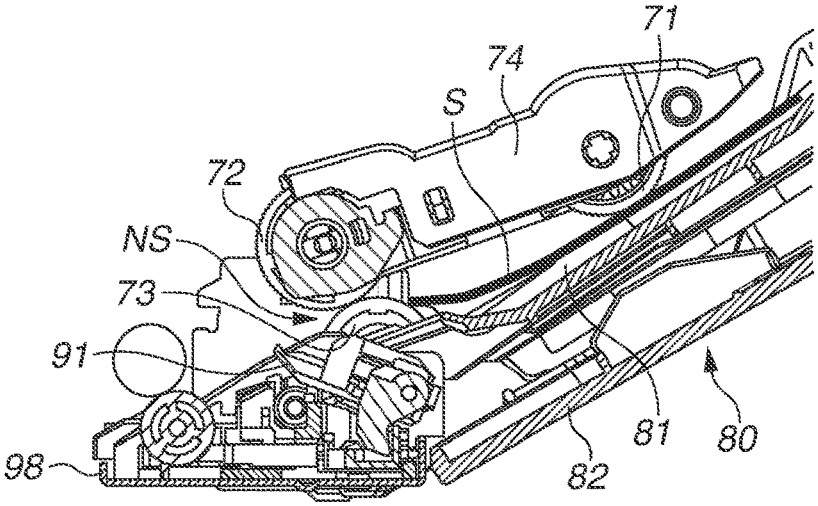
FIG. 11C is a diagram illustrating a state where the separation roller abuts the feed roller.
Figure 12:
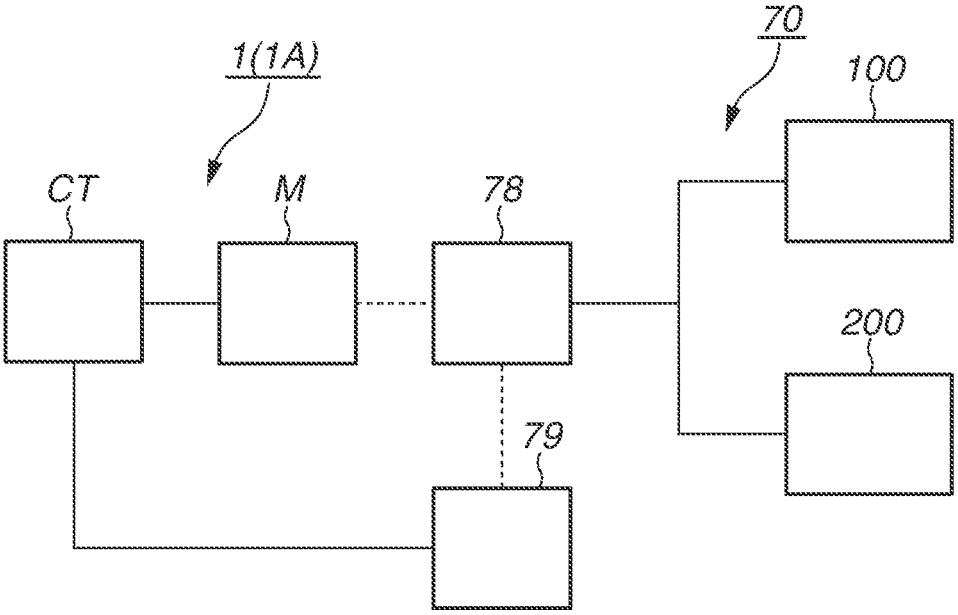
FIG. 12 is a diagram illustrating a control unit that controls the pick feed unit and the movement device.

FIGS. 11A to 11C are diagrams illustrating the conveying operation for conveying the sheet S from the stacking tray 81. FIG. 11A is a diagram illustrating the state where the pick roller 71 is away from the sheet S stacked on the stacking tray 81. FIG. 11B is a diagram illustrating the state where the pick roller 71 abuts the sheet S stacked on the stacking tray 81. FIG. 11C is a diagram illustrating the state where the separation roller 73 abuts the feed roller 72. FIG. 12 is a diagram illustrating a control unit that controls the pick feed unit 100 and the movement device 200.

Before the sheet S is conveyed from the stacking tray 81, then as illustrated in FIG. 11A, the pick roller 71 rises and is at the second position where the pick roller 71 is away from the stacking tray 81 and the sheet S. By separating the pick roller 71 from the stacking tray 81 and the sheet S, a user can easily place the sheet S in the stacking tray 81. The separation roller 73 is at the retracted position where the separation roller 73 is away from the feed roller 72. Further, the returning members 91 protrude to the conveying path (the path through which the sheet S passes).

In the present exemplary embodiment, the stacking tray 81 is sloping so that the sheet S moves downstream in a conveying direction DS by the weight of the sheet S. In other words, the stacking tray 81 is sloping so that a downstream end of the stacking tray 81 in the conveying direction DS is lower than an upstream end of the stacking tray 81 in the conveying direction DS. That is, the downstream end of the stacking tray 81 is located below the upstream end of the stacking tray 81 in the vertical direction. As a result, if the user places the sheet S in the stacking tray 81, the front end of the sheet S waits near the returning members 91. In the present exemplary embodiment, the sheet S waits in contact with the returning members 91.

As illustrated in FIG. 12, the apparatus main body 1A includes a control unit CT. The control unit CT controls the operations of the motor M and the solenoid 79. In other words, the control unit CT controls the pick feed unit 100 and the movement device 200 via the motor M and the solenoid 79. The motor M drives the pick feed unit 100 and the movement device 200.

If a command to form an image on the sheet S using the feeding device 70 is sent to the apparatus main body 1A, the control unit CT determines whether the sheet S is present on the stacking tray 81. This determination is made using a flag indicating the presence or absence of paper protruding from the stacking tray 81, and a photointerrupter (not illustrated).

If it is determined that the sheet S is present on the stacking tray 81, the solenoid 79 operates, the snaggletooth gear 78 starts rotating, and a driving force is transmitted from the motor M to the feeding device 70.

If the snaggletooth gear 78 rotates, the arm 74 swings, and the pick roller 71 falls. If the pick roller 71 moves to the sheet feeding position (the first position), the sheet S stacked on the stacking tray 81 and the pick roller 71 abut each other (see FIG. 11B).

On the other hand, the control cam 84 rotates in conjunction with the rotation of the snaggletooth gear 78. The control cam 84 rotates, whereby the movement device 200 operates, and as described above, the first movement member 75*a*, the second movement member 75*b*, and the holder supporting member 86 move. As a result, the separation roller 73 moves toward the abutment position where the separation roller 73 abuts the feed roller 72, and the returning members 91 retract from the conveying path of the sheet S (see FIG. 11C). In this state, the movement of the sheet S is restricted by the pick roller 71 that is stopped.

In the present exemplary embodiment, the returning members 91 may retract by the weights of the returning members 91, or may abut the sheet S and retract. In the present exemplary embodiment, the movements of the returning members 91 in the direction in which the returning members 91 retract are not restricted, and therefore, even in a case where the returning members 91 abut the sheet S and retract, the returning members 91 can retract from the conveying path without damaging the sheet S.

Next, the transmission of drive to the feed roller 72 and the pick roller 71 is started. The driving force from the motor M is transmitted through the snaggletooth gear 78, the feed shaft linking portion 95, and the roller shaft 90 to the feed gear 92. The driving force transmitted to the feed gear 92 is transmitted to the pick gear 101 via the idler gears 93*a* to 93*c*.

At this time, while the feed roller 72 rotates by the feed gear 92, the rotation of the pick roller 71 is restricted by a frictional force received from the sheet S. Thus, the drive transmission surfaces 101*a* and 102*a* are away from each other.

If the pick gear 101 rotates in the state where the pick roller 71 is stopped, the drive transmission surfaces 101*a* and 102*a* gradually come close to each other against the force of the spring 103, the cam surfaces 101*b*, and the cam surfaces 102*b* to separate the drive transmission surfaces 101*a* and 102*a*. At this time, the separation roller 73 already abuts the feed roller 72, and a separation nip ("NS" in FIG. 11C) is formed. That is, after the separation roller 73 abuts the feed roller 72, the drive transmission surfaces 101*a* and 102*a* abut each other, and the pick roller 71 is driven. Further, since the feed roller 72 is already driven, the separation roller 73 abutting the feed roller 72 is driven before the drive transmission surfaces 101*a* and 102*a* abut each other. That is, after the separation roller 73 is driven, the drive transmission surfaces 101*a* and 102*a* abut each other, and the pick roller 71 is driven.

As described above, in the state where the separation roller 73 abuts the feed roller 72 and the pick roller 71 abuts the sheet S stacked on the stacking tray 81 and is stopped, the feed roller 72 is driven. Then, after the feed roller 72 is driven, the drive transmission surfaces 101*a* and 102*a* abut each other, and the pick roller 71 is driven. During a predetermined time from when the feed roller 72 is driven to when the drive transmission surfaces 101*a* and 102*a* abut each other and the pick roller 71 is driven, the pick roller 71 is stopped.

Immediately after the rotation of the feed roller 72 is started, the separation function of the separation roller 73 (the function of separating a single sheet from a plurality of sheets) may not be sufficiently exerted. For example, this is due to the play of a member holding the separation roller 73 or the delay of response of the torque limiter built into the separation roller 73.

In the present exemplary embodiment, after the rotation of the feed roller 72 is started, the pick roller 71 rotates after a predetermined time interval. This can prevent the sheet S from being conveyed to the separation nip in the state where the separation function of the separation roller 73 is not sufficiently exerted. For example, before the front end of the sheet S reaches the separation nip, it is possible to remove the play of a portion holding the separation roller 73 or the delay of response of the torque limiter. Then, after the separation function is exerted, the drive transmission surfaces 101*a* and 102*a* abut each other, whereby the pick roller 71 is driven, and the feeding of the sheet S is started. As a result, the sheet S is conveyed toward the separation nip in the state where a desired separation function is exerted.

The pick roller 71 is configured to, after the sheet S is conveyed by a predetermined amount so that the front end of the sheet S reaches the separation nip of the feed roller 72 and the separation roller 73, separate from the sheet S by the arm 74 rising. If the pick roller 71 separates from the sheet S, the rotations of the pick roller 71 and the reception portion 102 linked to the pick roller 71 cease to be restricted. Thus, the delay mechanism 106 returns to the state where the drive transmission surfaces 101*a* and 102*a* are separate from each other by the biasing force of the spring 103.

As described above, after the sheet S is conveyed to a downstream conveying roller by the feed roller 72 and the separation roller 73, the separation roller 73 separates from the feed roller 72. The returning members 91 rotationally move in conjunction with the separation operation of the separation roller 73 and push a sheet S (a subsequent sheet) remaining near the separation nip back toward the stacking tray 81. Through the above operation, the feeding device 70 returns to the state illustrated in FIG. 11A.

Every time a single sheet S is conveyed, the feeding device 70 performs the above operation. By repeating this, the feeding device 70 conveys the sheet S stacked on the stacking tray 81.

If the sheet S is conveyed to the separation nip formed between the separation roller 73 and the feed roller 72 in the state where the separation function is not sufficiently exerted, the sheet S stopped by the separation roller 73 may be conveyed downstream in the conveying direction beyond a predetermined stop position.

To return the sheet S to the stacking tray 81 using the returning members 91, the sheet S needs to remain at the predetermined stop position so that the returning members 91 can touch the front end of the sheet S. In the present exemplary embodiment, after the feed roller 72 rotates in the state where the separation roller 73 abuts the feed roller 72, the pick roller 71 rotates after a predetermined time interval. As a result, it is possible to prevent the sheet S from moving downstream in the conveying direction beyond the position where the returning members 91 can contact the front end of the sheet S.

In a configuration in which the stacking tray 81 is sloping downward as in the present exemplary embodiment, the sheet S waits at a position close to the feed roller 72 and the separation roller 73. Thus, if the pick roller 71 rotates, the sheet S reaches the position of the separation nip between the feed roller 72 and the separation roller 73 in a short time. Even in such a configuration, the start of the rotation of the pick roller 71 is delayed, whereby it is possible to convey the sheet S toward the separation nip at an appropriate timing.

In the feeding device 70 according to the present exemplary embodiment, the stacking tray 81 is configured to be movable to a closed position and an opened position relative to the apparatus main body 1A. Specifically, as illustrated in FIG. 1, the stacking tray 81 is provided near the openable and closable door 82. When the stacking tray 81 is not used, the door 82 is closed, whereby the stacking tray 81 is accommodated within the apparatus main body 1A. The pick feed unit 100 is also configured to be movable about the feed roller 72 as its rotation center in conjunction with the opening and closing of the door 82, from the position where the pick feed unit 100 is used to the position where the pick feed unit 100 is accommodated within the apparatus main body 1A.

In the feeding device 70 according to the present exemplary embodiment, after the pick roller 71 rises and falls relative to the fixed stacking tray 81 without the stacking tray 81 rising and falling relative to the feed roller 72 and the separation roller 73 is driven, the conveyance of the sheet S can be started. Thus, it is possible to reduce the sound when the conveyance of the sheet S is started.

The feeding device 70 can employ not a sheet feeding roller having a large diameter that is fixed to the apparatus main body 1A, but the pick roller 71 having a small diameter that protrudes to outside the apparatus main body 1A together with the stacking tray 81 only when the pick roller 71 is used. Thus, it is possible to miniaturize the image forming apparatus 1.

The operations of the returning members 91 in conjunction with the abutment and separation of the separation roller 73, the abutment and separation of the pick roller 71, and the start of the driving of the pick roller 71 and the feed roller 72 are controlled by a single solenoid 79 provided in the apparatus main body 1A. Thus, it is possible to reduce the cost of the feeding device 70. In the present exemplary embodiment, the solenoid 79 is used as a component of a switching device that selectively causes the feeding device 70 to operate. However, any component other than a solenoid (e.g., an electromagnetic clutch) may be employed so long as the component can selectively transmit drive.

Although the compression spring 103 is used as a component for biasing the drive transmission surfaces 101*a* and 102*a* in the separation direction, any component other than a compression spring may be employed so long as the component is a biasing member having elasticity.

The delay mechanism 106 may be placed anywhere between the feed roller 72 and the pick roller 71. For example, a mechanism equivalent to the delay mechanism 106 may be placed in a portion of any of the idler gears 93*a* to 93*c*.

Although the spring 103 is configured to bias the pick gear 101 in the present exemplary embodiment, the present disclosure is not limited to this. The reception portion 102 may be configured to be movable, and the spring 103 may be configured to bias the reception portion 102 so that the drive transmission surfaces 101*a* and 102*a* move away from each other. That is, the spring 103 may only need to bias either of the first and second portions. In this case, the reception portion 102 is configured to be movable in a direction away from the pick gear 101 in the rotational axis direction of the pick gear 101.

The feeding device 50 in the apparatus main body 1A may include the delay mechanism 106. Even in a configuration in which the separation roller 73 is not movable to the retracted position, the delay mechanism 106 can be employed.

The configuration of an image forming apparatus to which a sheet feeding device according to the present disclosure is applied is not limited to the above configuration. For example, the present disclosure can be applied to an image forming apparatus in which an image is directly formed on a sheet S from a photosensitive drum. The present disclosure can also be applied to an image forming apparatus that forms a monochromatic image on a sheet S. Further, the present disclosure can be applied to an image forming apparatus other than a laser beam printer, such as an inkjet printer.

According to the present disclosure, it is possible to prevent a sheet from being conveyed toward a nip portion formed by a separation member and a conveying member before the separation member exerts a desired separation function.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-088470, filed May 26, 2021, which is hereby incorporated by reference herein in its entirety.

What is claimed is:

1. A sheet feeding device comprising:

a tray on which a sheet is to be stacked;

a feeding member configured to feed the sheet stacked on the tray;

a conveying member configured to convey the sheet fed by the feeding member;

a separation member configured to abut the conveying member and separate a single sheet from a plurality of sheets fed by the feeding member;

a transmission unit configured to transmit a driving force to the conveying member and the feeding member, wherein the transmission unit includes a first portion having a first transmission surface and includes a second portion configured to drive the feeding member and having a second transmission surface and, in case where the first and second transmission surfaces abut each other, the first portion drives the second portion; and a biasing member configured to bias either of the first and second portions so that the first and second transmission surfaces move away from each other, wherein (i) the conveying member is driven in a state where the separation member abuts the conveying member and the feeding member abuts the sheet stacked on the tray and is stopped, and (ii) after the conveying member is driven, the first and second transmission surfaces abut each other, and the feeding member is driven.

2. The sheet feeding device according to claim 1, wherein the feeding member is configured to be movable to a first position where the feeding member abuts the sheet stacked on the tray, and a second position where the feeding member is retracted from the first position.

3. The sheet feeding device according to claim 2, wherein the feeding member is configured to be swingable about the conveying member to move to the first and second positions.

4. The sheet feeding device according to claim 1, wherein one of the first and second portions is configured to be movable in a direction away from the other of the first and second portions in a rotational axis direction of the first portion.

5. The sheet feeding device according to claim 1, wherein the separation member is configured to be movable between an abutment position where the separation member abuts the conveying member, and a retracted position where the separation member is retracted from the abutment position, and wherein, after the separation member abuts the conveying member, the first and second transmission surfaces abut each other, and the feeding member is driven.

6. The sheet feeding device according to claim 5, further comprising a returning member configured to return the sheet from a portion between the conveying member and the separation member toward the tray in a state where the separation member is located at the retracted position.

7. The sheet feeding device according to claim 5, further comprising a separation movement portion configured to move the separation member to the abutment position and the retracted position.

8. The sheet feeding device according to claim 1, wherein the second portion is linked to an end portion of the feeding member.

9. The sheet feeding device according to claim 1, wherein the first portion includes a first abutment surface, wherein the second portion includes a second abutment surface, and wherein the first and second transmission surfaces separate from each other in a case where the first and second abutment surfaces abut each other by a force of the biasing member.

10. The sheet feeding device according to claim 9, wherein the first abutment surface is sloping relative to a rotational axis direction of the first portion, and the second abutment surface is sloping relative to a rotational axis direction of the second portion.

11. The sheet feeding device according to claim 1, wherein the separation member is configured to be rotatable.

12. The sheet feeding device according to claim 1, wherein the tray is sloping so that a downstream end of the tray in a conveying direction of the sheet is lower than an upstream end of the tray in the conveying direction.

13. The sheet feeding device according to claim 1, wherein the tray is configured to be movable to a closed position and an opened position relative to an apparatus main body.

14. An image forming apparatus comprising:

the sheet feeding device according to claim 1; and an image forming unit configured to form an image on the sheet.

* * * * *